US005195878A

United States Patent [19]

Sahiavo et al.

[11] Patent Number: 5,195,878

[45] Date of Patent: Mar. 23, 1993

[54] AIR-OPERATED HIGH-TEMPERATURE CORROSIVE LIQUID PUMP

[75] Inventors: John Sahiavo; Robert Garber, both of Sunnyvale, Calif.

[73] Assignee: Hytec Flow Systems, Sunnyvale, Calif.

[21] Appl. No.: 703,192

[22] Filed: May 20, 1991

[51] Int. Cl.[5] ..... F04B 45/02; F16S 3/04

[52] U.S. Cl. ..... 417/393; 417/473; 91/300; 92/34

[58] Field of Search ..... 417/472, 473, 393; 91/300; 92/34, 35

[56] References Cited

U.S. PATENT DOCUMENTS

| | | | |
|---|---|---|---|
| 279,452 | 6/1883 | SinClair | 417/473 |
| 862,867 | 8/1907 | Eggleston | 417/390 |
| 2,383,486 | 8/1945 | Isenberg | 417/473 |
| 2,657,074 | 10/1953 | Schwester | 92/34 |
| 2,951,450 | 9/1960 | Fisher | 417/473 |
| 3,166,658 | 1/1965 | Jennings | 92/34 |
| 3,182,597 | 5/1965 | Malizard | 417/473 |
| 3,319,532 | 5/1967 | Pridham | 92/34 |
| 3,369,411 | 2/1968 | Hines | 92/34 |
| 4,386,888 | 6/1983 | Verley | 717/393 |
| 4,618,425 | 10/1986 | Yates | 417/473 |
| 4,624,628 | 11/1986 | Marchant | 417/393 |
| 4,854,832 | 8/1989 | Gardner | 417/393 |

FOREIGN PATENT DOCUMENTS

| | | | |
|---|---|---|---|
| 5713281 | 1/1982 | Japan | 417/393 |

*Primary Examiner*—Richard A. Bertsch
*Assistant Examiner*—Peter Korytnyk
*Attorney, Agent, or Firm*—Limbach & Limbach

[57] ABSTRACT

A liquid pump is disclosed having a center block containing inlets and outlets for liquid to be pumped and air to operate the pump with associated valves for liquid and air. A pair of opposed cylinders are provided on opposite sides of the center block and each containing a collapsible bellows connected to a sleeve forming a piston with the liquid being pumped in the chamber within the bellows. Push rodes extend from one piston to the other so that the piston pumping liquid out pushes the other piston to fill with liquid. The bellows have conbolutions of selectively varying wall thickness, and tapered single or dual compression seals are provided where the bellows are joined to the center block. An inflow conical valve and an outflow shuttle valve are provided for each cylinder, and vent tubes are provided to cool the bellows and to actuate the air valve at the end of the piston stroke. An encapsulated sheet member is provided in each cylinder.

43 Claims, 6 Drawing Sheets

AIR-OPERATED HIGH-TEMPERATURE CORROSIVE LIQUID PUMP

BACKGROUND OF THE INVENTION

The present invention relates to the pumping of corrosive liquids like sulfuric, nitric, perchloric, phosphoric, hydrofluoric, hydrobromic and other acids, bases, liquid halogens, etchants, etc. which are used in chemical and related industries.

It has been especially difficult to pump these liquids reliably at elevated temperatures like 150° to 200° C., as required in some chemical operations. In addition, corrosives may have to be pumped to higher pressure levels e.g., for loading or filtration purposes. Since electric motors have reliability problems in a corrosive environment, a pump of this type is usually driven by compressed air or nitrogen. Another consideration is avoidance of the use of metal in the liquid path, like for valve springs, since it severely limits the reliability of the pump.

Teflon is a plastic that can withstand chemical attack to a much better degree than most other materials. Teflon diaphragm pumps are successfully used but usually show diaphragm fatigue after some operating time at elevated temperatures. Other problems with Teflon are dimensional changes as a function of temperature which can result in leakage of liquid or working gas from the joints of assembled parts.

A new pump incorporating novel design features towards the solution of the problems mentioned above is detailed in the following description.

SUMMARY OF THE INVENTION

The goal of this invention is to provide a pump with an all-Teflon liquid path, both enhanced reliability and absence of leakage of air and liquid at high temperatures (up to about 200° C.), valve operation by pressure differential or gravity without corrosion-endangered metal springs, full corrosion-protective encapsulation of the few metal parts holding the assembly together or their replacement by high-strength plastic parts to minimize the acquisition of radioactivity in nuclear environments.

Additional goals are the capabilities of the pump to operate reliably in corrosive and explosive atmospheres and to be certifiable for clean room use. These requirements are met by driving the pump by a compressed working gas like air or nitrogen, which is hereafter merely called "working air." This working air should be free of oil and moisture.

The proposed pump operates in a two-stroke fashion and consists of (a) a center block containing the inlets and outlets for the liquid to be pumped, with associated valves, and the outlet for the air used to drive the pump;

(b) a pair of opposing cylinders, mirror-symmetrically arranged on either side of the center block and each containing symmetrical O-ring sleeves with bellows inside, forming "pistons"; and (c) a valve block, which contains the inlet for the working air, a control shuttle valve for control of the working air and ports ducting the working air to the center block.

The pump of this invention additionally includes a number of structural features which produce a unique pump construction but which is also useful in other applications. These are described below.

The open ends of the cup-shaped bellows are screwed into the center block with liquid inflow and outflow valves contained within and the respective O-ring sleeves are screwed onto the closed ends of the bellows such that their combined outside face ends form the flush surface of "pistons." The inside face ends of the O-ring sleeves on either side are in contact with each other via four symmetrically arranged sliding push rods extending through the center block and acting as spacers. When the air expands the chamber of one cylinder (the space between the back end of the cylinder and the piston end of the O-ring sleeve), the piston moves towards the center block; the respective bellows gets compressed; and its liquid content gets exhausted via the output shuttle valve, effecting the exhaust stroke. Simultaneously, the push rods cause the piston on the opposite side to move away from the center block expanding its bellows and sucking in liquid in its intake stroke via a input ball valve while expelling the used air from the respective chamber via a muffler outlet to the outside air.

The pump of this invention includes a number of additional structural features which produce a unique pump construction but which are also useful in other applications. These are described below:

Compensated convoluted bellows with the wall thickness varying from the closed end to the open end equalize stress patterns developing during compression and expansion.

Tapered single or dual compression seals, to prevent leakage at elevated temperatures and pressures, around the open end of the bellows at their connection to the center block.

Inflow conical valves, one per cylinder, are screwed into the center block and protrude into the respective bellows acting as one-way valves for the inflow of the liquid. Each valve contains a limited conical space extending upwards from the cone tip close to the center block to a partially open cage cap pressed onto the other valve end, which limits the movement of a Teflon ball on the slope of the cone. This movement is effected by a pressure differential and by gravity without the use of a spring, which is subject to corrosion or fatigue from heat, or both. In the exhaust stroke pressure differential and gravity move the ball into the lower, narrower position of the cone, thus effectively closing off the liquid flow from the bellows towards the center block. In the intake stroke the opposite pressure differential rolls the ball up the cone into the higher position where it is confined by the cage, thus allowing the liquid to flow into the bellows.

An outflow shuttle valve serves both cylinders and operates by a pressure differential to facilitate the liquid exhaust from one bellows while closing off the opening to the other bellows presently in the liquid intake stroke.

Vent tubes, called "vents," protruding from the center block, one into each cylinder, act as pneumatic stroke terminators and provide air for effective cooling of the bellows, especially when pumping liquid at elevated temperatures. A small portion of the working air is constantly flowing in ducts, having a relatively small cross-section, through the valve block, the center block, through a vent into the space between a bellows and the respective cylinder and on to the outside air via a permanent opening at the bottom side of the center block. When during an exhaust stroke in the first cylinder the O-ring sleeve approaches or touches the respective vent, the venting of working air is decreased or even stops and consequently the pressure in that respective duct increases, pushing the control shuttle into the other extreme position. This action fills the chamber in the opposite second cylinder with expanding working air and initiates a liquid exhaust stroke there and a liquid intake stroke in the first cylinder. The cooling of the bellows can also be accomplished by blowing air directly through the space between cylinders and their respective bellows to the outside air.

Encapsulated strength members in the form of a band surround the chamber of each cylinder to maintain stable dimensions even at elevated temperatures, thus allowing for reliable operation of the O-ring sleeves.

DESCRIPTION OF THE PREFERRED EMBODIMENTS

Figure 1:
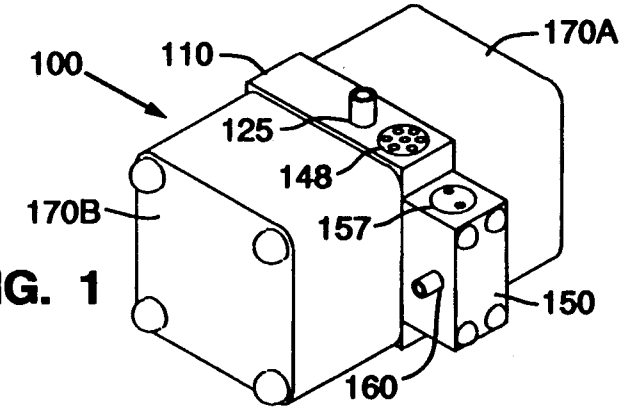
FIG. 1 is a perspective view of the assembled pump.
Figure 3:
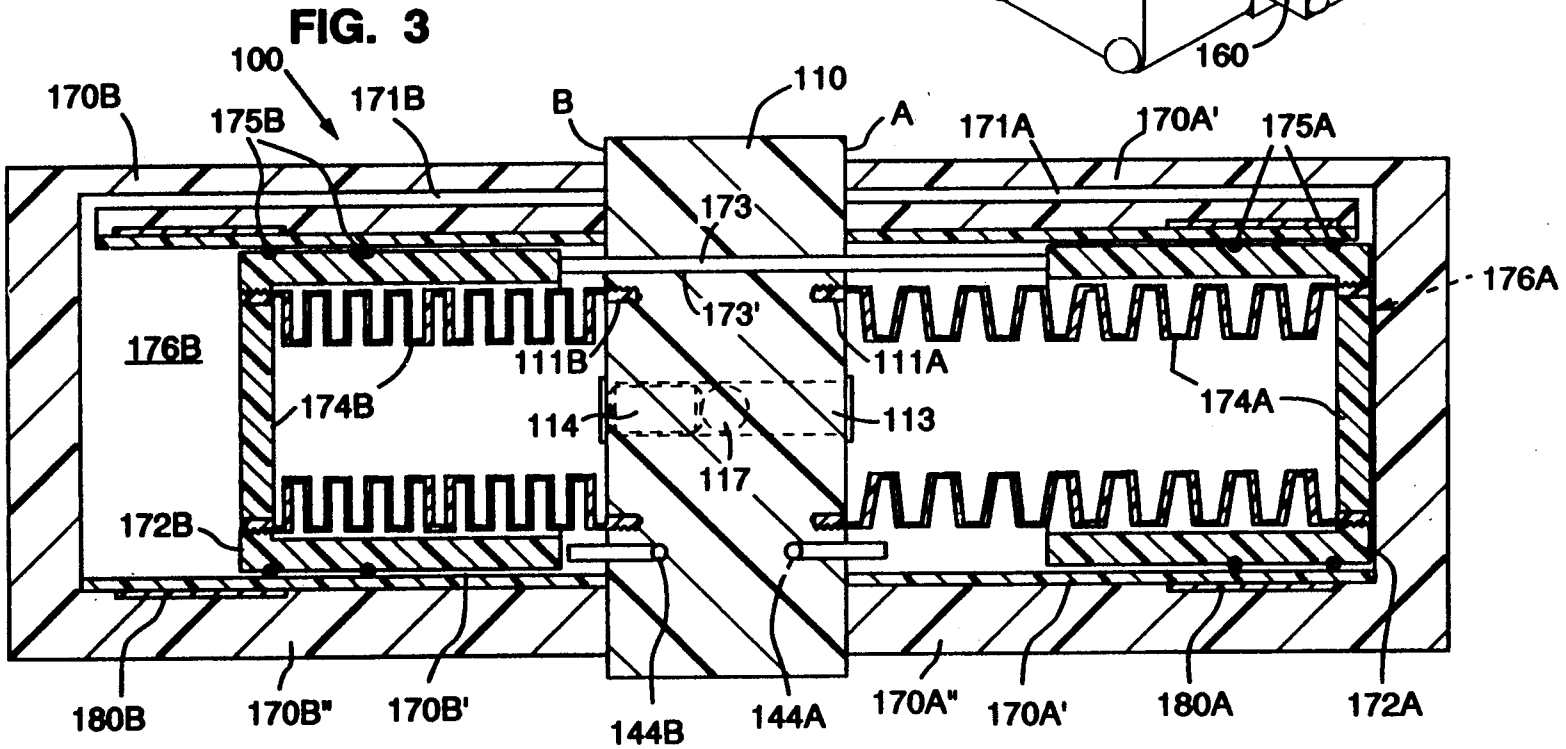
FIG. 3 is a sectional view of the entire assembly.

Pump 100 consists of center block or body 110, the pair of opposing cylinders 170A and 170B, which are mirror-symmetrically attached to face sides A and B of center block 110, respectively, and valve block 150, which is attached to one small side of center block 110.

The liquid inflow is directed by the inflow ball valves 118A and 118B, respectively mounted on faces A and B of center block 110. The liquid outflow is directed by the outflow shuttle 114. Inflow valves and outflow valves both protrude into respective bellows 174A and 174B.

The working air inflow and outflow are directed by a control shuttle 152 and the reversals of flow direction, translating into reversals of strokes, are initiated by the closing of vents 144A or 144B, protruding from face sides A and B of center block 110, by the inside face ends of O-ring sleeves 172A and 172B, respectively.

Center block 110 bears two central, circular and threaded bellows grooves 111A and 111B, one each on face sides A and B, into which respectively the threaded open ends of bellows 174A and 174B are screwed. Located inside the circle of grooves 111A and 111B are two side-by-side parallel bores, horizontal and perpendicular to the two faces of center block 110.

One is bore 119 with threaded ends for receiving inflow ball valves 118A and 118B, and connected to vertical liquid inlet 125 on center block 110, which has a threaded opening for receiving a vertical ½" NPT liquid inlet hose.

The other bore is outflow shuttle cavity 113 with threaded ends for allowing the movement of cylindrical outflow shuttle 114 and for receiving its caging outflow shuttle caps 115A and 115B. Outflow shuttle cavity 113 is perpendicularly connected to horizontal liquid outlet 117, centered on the small side face of center block 110 opposite from the valve block 150 interface, with its threaded opening for receiving a ½" NPT liquid outlet hose.

Outside of the circle of grooves 111A and 111B are small bored holes through the center block 110 for the four sliding push rods 173 extending between and in constant contact with the inside faces of O-ring sleeves 172A and 172B. In the corners of central block 110 are four drilled holes for the assembly bolts 164 which hold cylinders 170A and 170B and thus the entire pump assembly 100 together.

Figure 2:
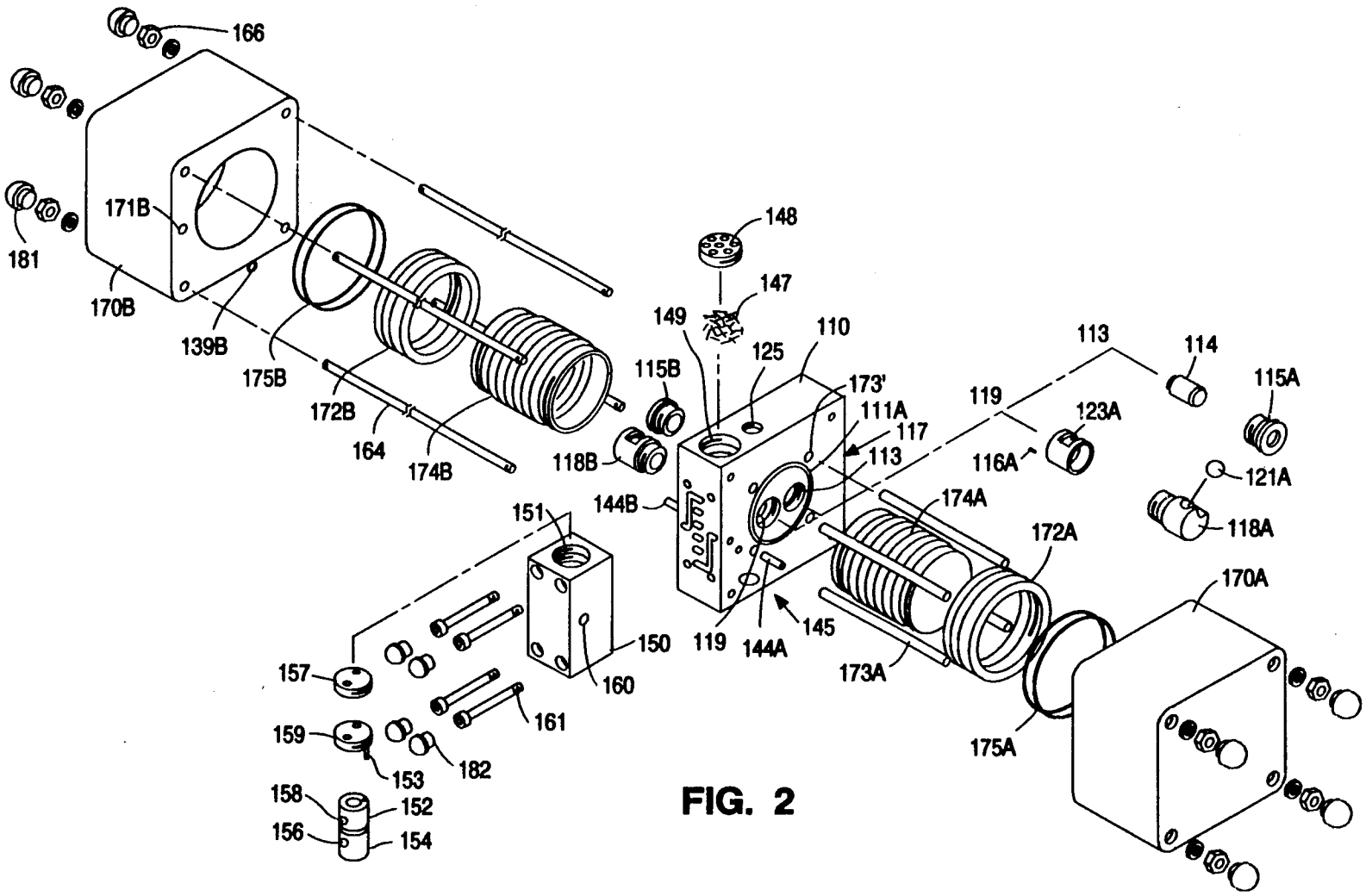
FIG. 2 is an exploded perspective view.

The outside faces of O-ring sleeves 172A and 172B are screwed onto and flush with the closed ends of bellows 174A and 174B, thus forming slidable "pistons" within cylinders 170A and 170B, guided and separated from the cylinder walls by sets 175A and 175B of at least two O-rings each, respectively (see FIG. 2). The spaces between the closed ends of cylinders 170A and 170B and the "pistons" are chambers 176A and 176B which are connected via horizontal ducts 171A and 171B in cylinders 170A and 170B to slanted ducts 130A and 130B in center block 110 for intake and exhaust of working air with O-rings 139A and 139B ascertaining a tight seal between center block 110 and cylinders 170A and 170B.

Figure 6:
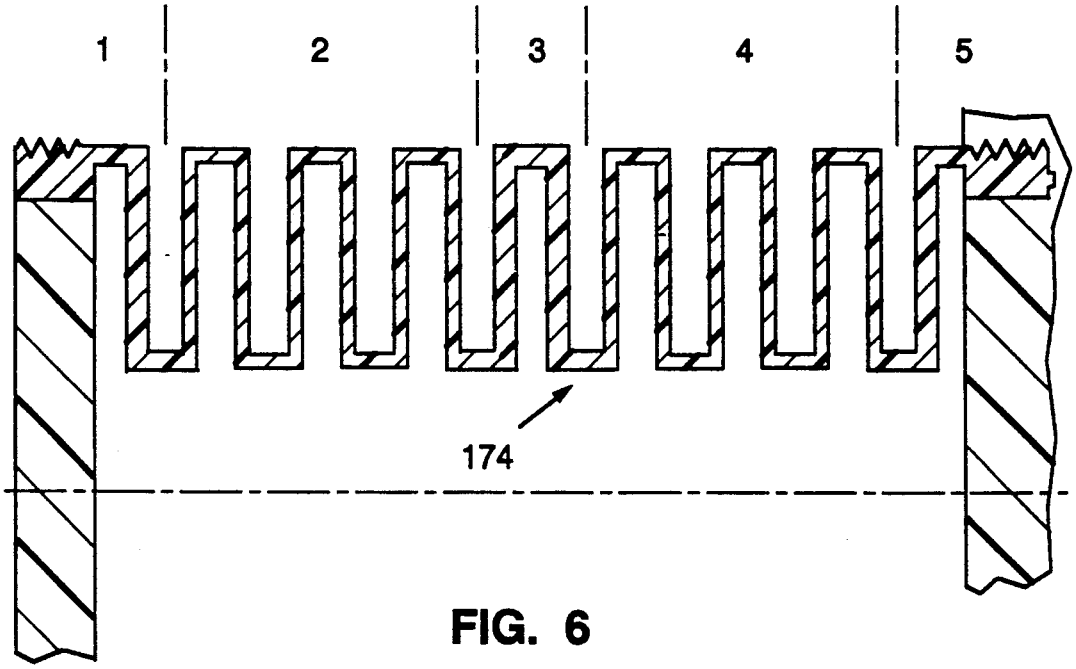
FIG. 6 shows an enlarged, elevational, sectional view, not to scale, of a portion of the compensated convoluted bellows of this invention.

As shown in FIG. 6 bellows 174A and 174B have thicker walls close to the open and closed ends and in the middle and have thinner walls on both sides between the middle and the ends thereby providing maximum flexibility where it is needed and evening out stress patterns for enhanced reliability. The insides of O-ring sleeves 172A and 172B surround bellows 174A and 174B at a slightly larger diameter and prevent them from yawing, thus equalizing stress patterns and enhancing reliability, and also prevent the bellows overexpansion under higher pressures when the Teflon bellows turn softer at elevated temperatures.

The inside face ends of O-ring sleeves 172A and 172B are in constant contact with each other via four symmetrically arranged sliding push rods 173 extending through bored holes 173' in center block 110 such that during the expansion of chamber 176A the inside face end of O-ring sleeve 172A containing the active, compressing and exhausting bellows 174A pushes, by means of push rods 173, the inside face end of O-ring sleeve 172B containing the passive, expanding and intaking bellows 174B, thus compressing chamber 176B. The length of push rods 173 is selected so that at the end of the active exhaust stroke of cylinder 170A, O-ring sleeve 172A partially blocks the flow of air through the vent tube 144A and intaking bellows 174B reaches the end of its compressing chamber 176B slightly before the inside face end of the O-ring sleeve 172A, driven by the active and expanding chamber 176A, touches the tip of the respective vent 144A thus preventing wear and tear at that tip. Center block face sides A and B are interchanged for the reverse stroke.

The valve block 150 is attached vertically to the vertical end side of center block 110 by means of four assembly bolts 161 through drilled holes in the corners of its interface sides.

Figure 5B:
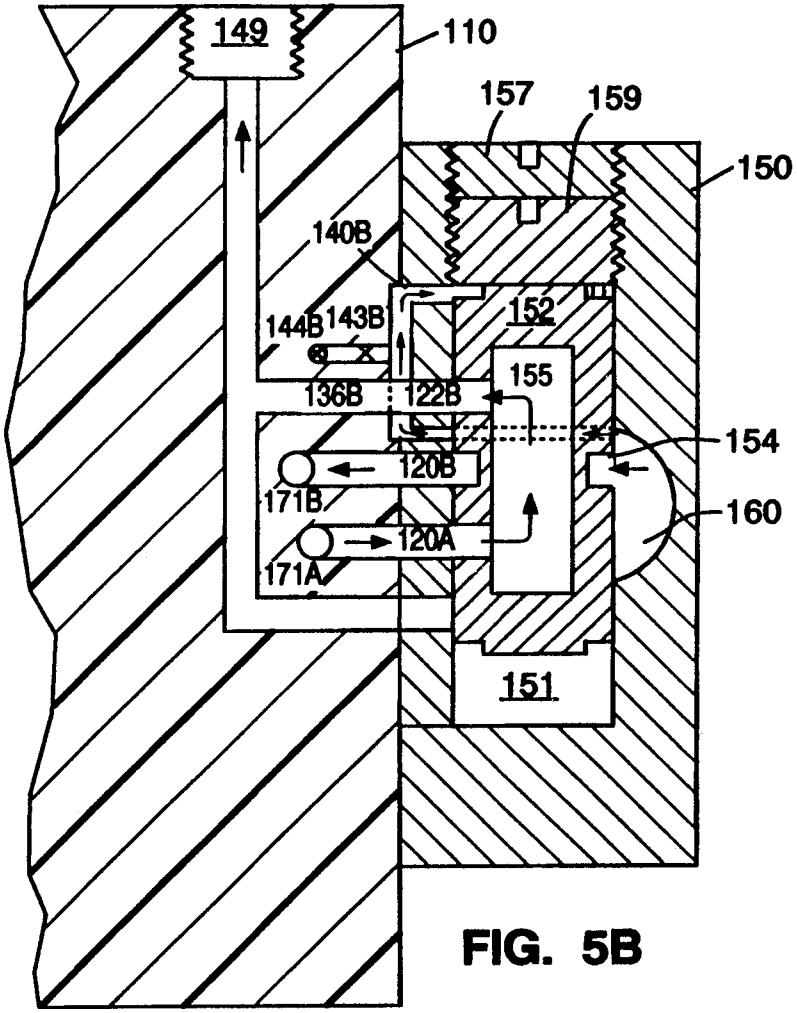
FIGS. 5A and 5B are elevational sectional views of a portion of the center block and valve block showing the two positions of the control shuttle and the sequence of air flows at the moment when a vent is closed.
Figure 5A:
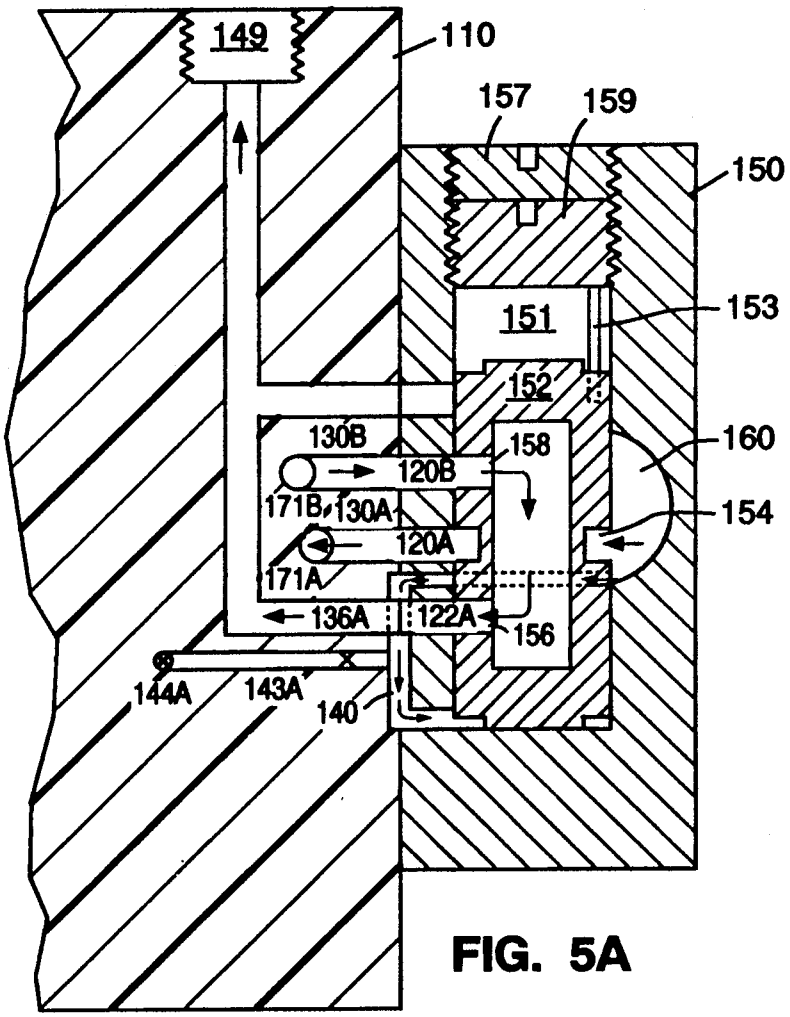

Valve block 150 contains air inlet 160 and valve block cavity 151, which is designed to hold control shuttle 152 within and to allow it approximate travel distance such as about ⅜" (9 mm) in the preferred embodiment between lower and higher extreme positions shown in FIGS. 5A and 5B respectively. The upper end of valve block cavity is closed off by shuttle screw insert 159, holding pin 153, on the inside and by valve block cavity screw 157 on the outside. Control shuttle 152 consists of a hollow cylinder, having a circumferential center groove 154 around its middle, which initially (before the working air is turned on) rests in the lower position shown in FIG. 5A of valve block cavity 151 by force of gravity. Control shuttle 152 also has two circumferentially extending elongated holes 156 and 158, connected by its internal cavity 155, which are located symmetrically to and on opposite sides of center groove 154.

The valve block 150 has openings on its interface side matched by corresponding openings on the small side of center block 110. Four of these openings are elongated openings 120A, 120B, 122A and 122B centered along the major axis along the length of valve block 150. Elongated openings 120A and 120B are innermost and belong to slanted ducts 130A and 130B, which connect to ducts 171A and 171B to supply and exhaust working air to and from chambers 176A and 176B in cylinders 170A and 170B, respectively. Elongated openings 122A and 122B are located adjacent and away from the minor axis and belong to L-shaped ducts 136A and 136B, which both lead to muffler outlet 149 at the top or on the small side of center block 110. The two outermost openings aligned with the width of valve block 150 and symmetrically removed from the major axis belong to ducts 141A and 141B described below. Pin 153 protruding from shuttle screw insert 159 prevents control shuttle 152 from rotating around its axis such that elongated holes 156 and 158 are always facing and lined up with the pair of elongated openings 120A and 122A or the pair of elongated openings 120B and 122B.

Depending on control shuttle 152 being in the lower or upper position, center groove 154 provides a path for working air from air inlet 160 to one of elongated openings 120A or 120B respectively, thus through either ducts 171A or 171B, to either chamber 176A or 176B, respectively, for an active stroke (liquid exhaust) of the respective cylinder. Conversely, the inner cavity 155 of control shuttle 152 provides a path, Via elongated holes 156 and 158, for the exhaust of used working air to the outside by connecting elongated openings 120A and 122A or elongated openings 120B and 122B from either chamber 176A or 176B, respectively, in a passive stroke (liquid intake) of the respective cylinder.

In the lower position of control shuttle 152 shown in FIG. 5A center groove 154 uncovers elongated opening 120A, thus allowing working air to flow into expanding, active chamber 176A via slanted duct 130A and duct 171A for the liquid exhaust stroke of cylinder 170A, while providing an exit path for used air from now compressing, passive chamber 176B via duct 171B, slanted duct 130B, elongated opening 120B, elongated holes 156 and 158 connected by the cavity 155 inside control shuttle 152, elongated opening 122B, duct 136B to muffler outlet 149 for the liquid intake stroke of cylinder 170B. The same sequence holds true for the reverse stroke, with indices A and B interchanged, when in the higher position of control shuttle 152 its center groove 154 uncovers elongated opening 120B.

Figure 9:
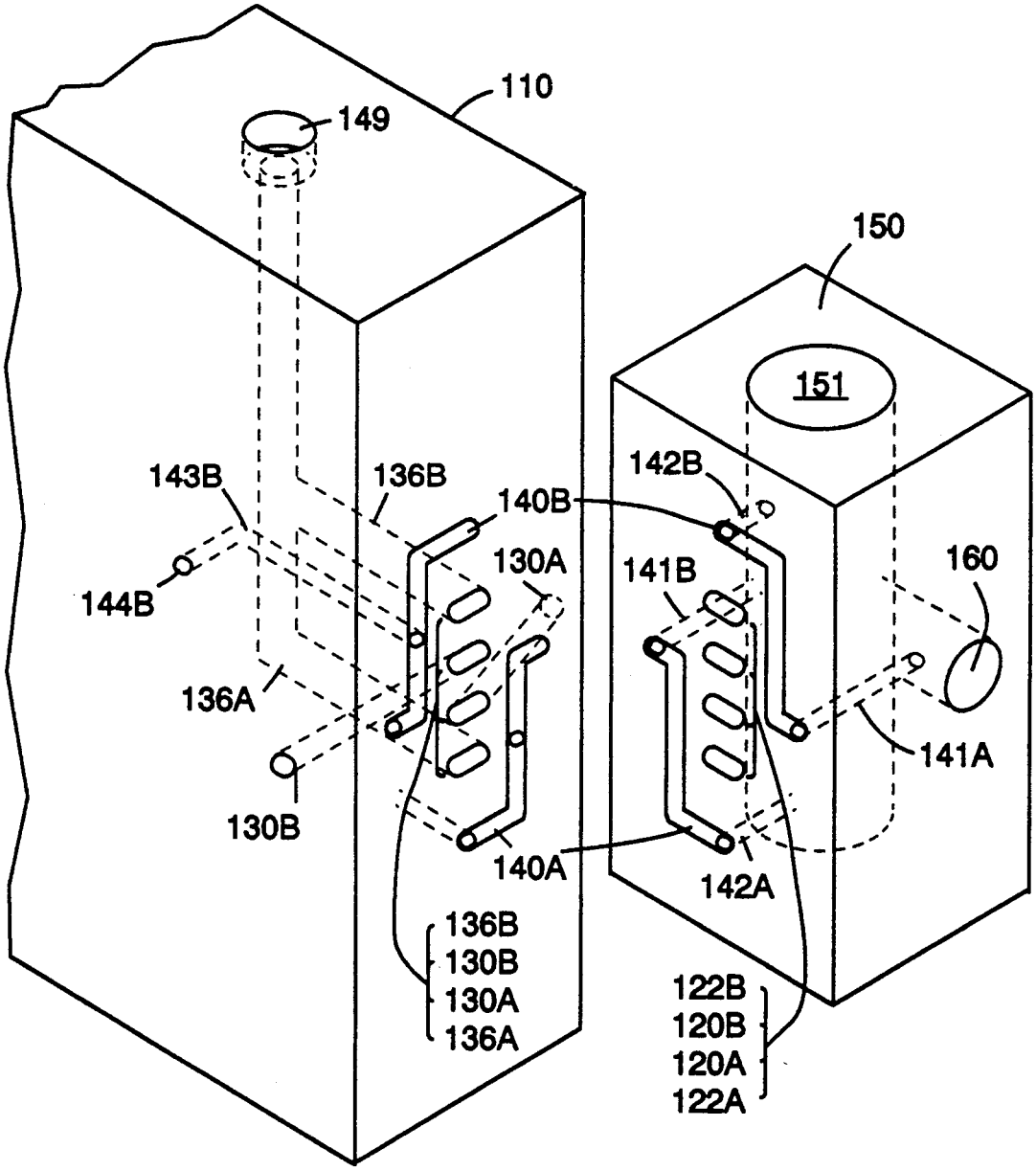
FIG. 9 is a partial prospective view of the interface of the center block with the valve block folded open.

The interface between valve block 150 and center block 110 also contains Z-shaped surface channels 140A and 140B shown in FIG. 9 of the center block 110 side facing the valve block 151, located 180 degrees around the interface center from each other with the short horizontal sides of the "Z" pointing toward the respective cylinders 170A and 170B. Surface channels 140A and 140B are jointly formed by appropriately shaped surface areas on valve block 150 and on center block 110. Working air flows from air inlet 160 via center groove 154 and via ducts 141A and 141B within valve block 150, which are arranged along its width (its minor axis) and mirror-symmetrically to its length (its major axis), perpendicularly onto the long end of the Z-shaped surface channels 140A and 140B. In the middle of the long sides of the Z-shaped surface channels 140A and 140B are openings for perpendicular ducts 143A and 143B within center block 110, which in turn are connected to Vents 144A and 144B in cylinders 170A and 170B. The short ends of Z-shaped surface channels 140A and 140B perpendicularly connect to the upper and lower ends of control shuttle cavity 151 within valve block 150 via ducts 142A and 142B, respectively. The closing of vent 144A, which otherwise bleeds air for cooling into the space between cylinder 170A and its bellows 174A, by the inside face of moving O-ring sleeve 172A, increases the pressure in surface channel 140A, duct 142A and consequently in the lower end of control shuttle cavity 151, which in turn moves control shuttle 152 into the opposite, higher position initiating the reverse stroke.

The air bleeding from vents 144A and 144B for the cooling of bellows 174A and 174B is exhausted via permanently open air vent 145 in the bottom of the center block to the outside atmosphere.

The small cross-sections of ducts 141A and 141B and of surface channels 140A and 140B cause a significant drop of pressure, compared to that at air inlet 160, in the air which at all times (except for very short moments when closing of a vent initiates a stroke reversal) bleeds out of both vents for cooling and which flows to the outside via opening air vent 145 in center block 110 This means in practical terms that only a rather small portion of the working air is diverted for shuttle control and the cooling of the bellows.

A pack of Teflon shavings 147 at muffler outlet 149 serves to muffle the air exhaustion sound of every stroke, and is held in by muffler outlet screw 148.

Caps 181 and 182 encapsulate the ends of assembly bolts 164 and nuts 166, respectively, and protect them from corrosive influence of the outside.

Figure 4A:
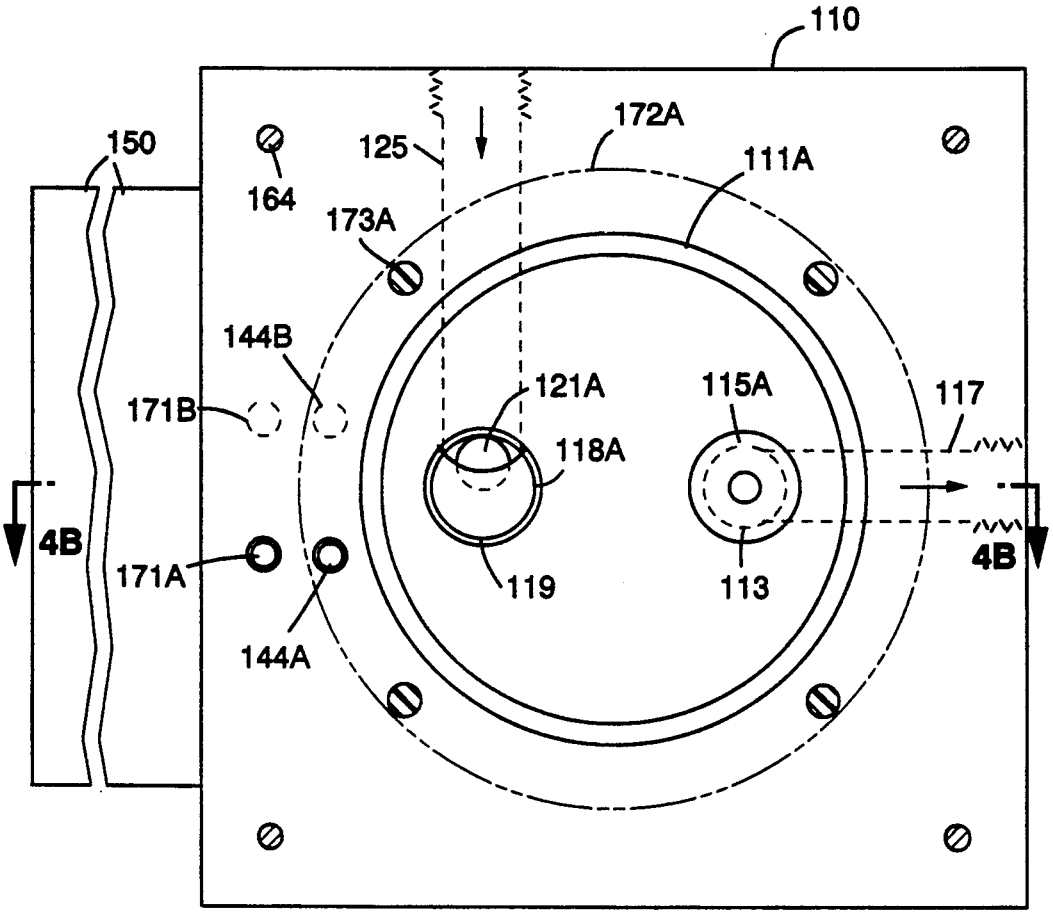
FIG. 4A is an elevational sectional view of the center block and valve block showing the liquid pathways.
Figure 4B:
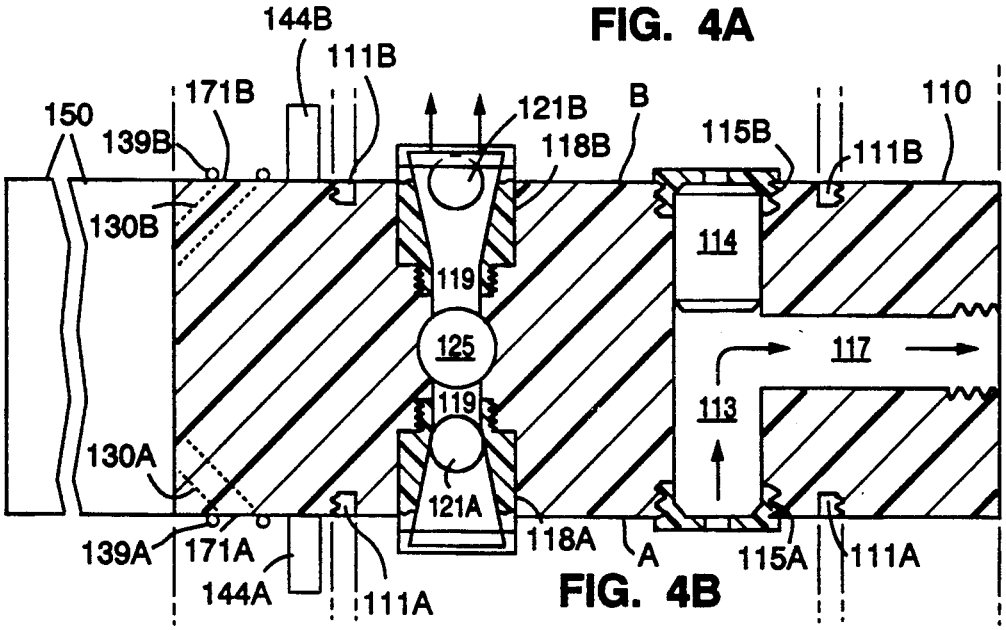
FIG. 4B is a sectional view of the structure shown in FIG. 4A taken along line 4B—4B in the direction of the arrows.

The following description of on stroke illustrates the workings of the pump (the other stroke is identical with only the cylinders and designations A and B interchanged):

Initially, as shown in FIG. 5A with the working air turned off, control shuttle 152 is in the lower position by force of gravity with elongated opening 120A connected to air inlet 160 by center groove 154. When then the working air is turned on, it flows via elongated opening 120A, slanted duct 130A, duct 171A into expanding chamber 176A. 0-Ring sleeve 172A moves towards center block 110, and the increased liquid pressure by compressing bellows 174A pushes output shuttle 114 into the opposite position, thus initiating the liquid exhaust stroke (See FIGS. 4A–4B) by opening the path for the liquid volume contained in bellows 174A to be pushed out of the liquid outlet 117. The pressure and gravity rolls the Teflon ball 121A in inflow ball valve 118A into its lowermost position in its conical cage, effectively obstructing liquid flow and locking the ball in place.

This action also moves the four sliding push rods 173, being in contact between the inside face ends of 0-ring sleeves 172A and 172B, to expand bellows 178B for its intake stroke. The decreased liquid pressure rolls the Teflon ball of 121B inflow ball valve 118B out of its lowermost rest position upwards into a predetermined position in its conical cage, allowing bellows 174B to suck in a corresponding volume of liquid from liquid inlet 125 with minimum turbulence avoiding cavitation bubbles. The air in chamber 172B is simultaneously exhausted via duct 171B, slanted duct 130B, elongated opening 120B, elongated hole 56, inner cavity of control shuttle 152, elongated hole 158, elongated opening 122B, duct 136B and finally out of muffler outlet 149.

When the bellows 174A reaches its most compressed state and closes the open end of vent 144A which normally bleeds cooling air over bellows 178A, the increased air pressure in perpendicular duct 143A, in surface duct 140A, in duct 142A and consequently at the lower end of control shuttle cavity 151 moves control shuttle 152 to the higher position, thus initiating the opposite stroke.

Now working air flows via center groove 154, elongated opening 120B, slanted duct 130B, duct 171B into chamber 176B.

Then chamber 176B is expanding an l bellows 174B is compressed, pushing the outlet shuttle 114 into the first position and pumping its liquid volume out of the liquid outlet 117. Bellows 178A is now expanding, sucking in liquid via input ball valve 118A and expelling the air out of chamber 172A via duct 171A, slanted duct 130A, elongated opening 120A, elongated hole 156, inner cavity 155 of control shuttle 152, elongated hole 158, elongated opening 122A, duct 136A and out of muffler outlet 149.

When bellows 174B reaches its most compressed state, the inside face of O-ring sleeve 172B closes the open vent 144B, thus increasing air pressure in perpendicular duct 143B, in surface duct 140B, in duct 142B and consequently at the higher end of the control shuttle cavity 151 moving control shuttle 152 into the lower position and initiating the sequence again.

The following novel features have been included in the design of this pump:

The compensated convoluted bellows 174A and 174B (see FIG. 6) allow for a stroke of about one inch (2.5 cm). If the length of the bellows is divided into five sections, 1 at the closed end near O-ring sleeves 172A and 172B, 3 in the middle and 5 at the open end near center block 110, then a thicker bellows wall in sections 1, 3 and 5 and a thinner wall in sections 2 and 4 produces flexure stress pattern equalization. The thicknesses shown in FIG. 6 are not drawn to scale and are exaggerated for purposes of illustration. In the preferred embodiment if the wall thickness of the convolutions in sections 1 and 5 is designated 100%, then the wall thickness in section 3 is about 91% and in sections 2 and 4 is about 87%.

Figure 7:
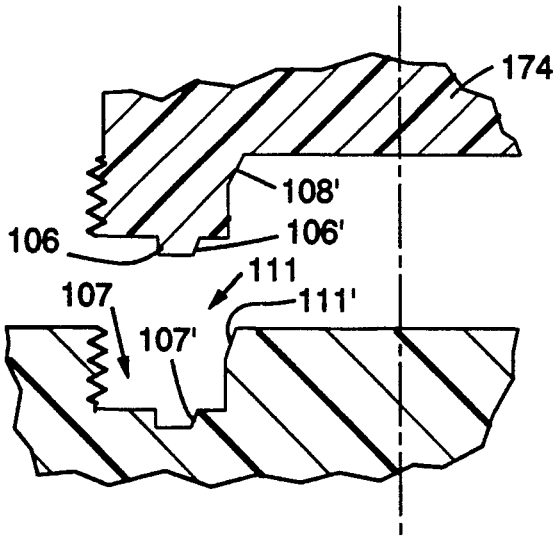
FIG. 7 shows an enlarged sectional view of a tapered compression seal of this invention.

The single and dual tapered compression seals (see FIG. 7) compress the single or dual rectangular edges of one part (e.g., bellows 174A and 174B) with corners of the mating part (e.g., the center block grooves 111A and 111B). The end of the bellows, 174 has a projection 106 which mates with a matching recess 107 in the groove 111. The projection 106 and recess 107 have tapers 106' and 107' expanding in the direction of the closed end of the bellows 174. Similar tapers 108' and 111' are provided on the bellows and the opening of groove 111, respectively. The tapers are slanted in the axial direction, such that axial pressure, generated by screw action, exerts a radial pressure in the joint which tightens the seal at the threads.

Figure 8:
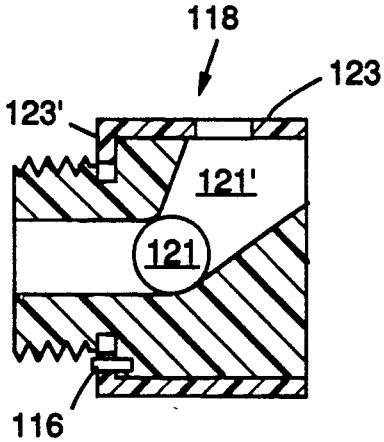
FIG. 8 shows an enlarged elevational sectional view of an inflow ball valve of this invention.

The inflow ball valves 118A and 118B (see FIG. 8 and FIG. 2) are screwed one into faces A and B of center block 110 allowing liquid flow into bellows 174A and 174B, respectively, and obstructing liquid flow out of these bellows in a one-way fashion. In inflow ball valve 118A a Teflon ball 121A is contained in a conical caged space 121' expanding upwards from the center block end at an angle of about 30 degrees an terminated by partially open caging inflow valve cap 123A. The shoulder of inflow ball valve 118A pushes the shoulder 123' of inflow valve cap 123A firmly against face side A of center block 110 while locking pin 116A, fitting into one of several holes in that face side of center block 110, and prevents the unscrewing of inflow ball valve 118A. When moving from its position at the tip of the cone under the influence of a pressure differential during the intake stroke, Teflon ball 121A allows fluid inflow into bellows 174A as it rolls up the conical slope of inflow ball valve 118A and is locked into a predetermined position against caging inflow valve cap 123A which is covering the other valve end. This action allows laminar flow via a large cross-section into bellows 174A but prevents Teflon ball 121A from oscillating and creating turbulence which can cause cavitation bubbles at higher stroke frequencies. Teflon ball 121A obstructs liquid outflow in the exhaust stroke when it has returned to the lower and narrower position of the cone of inflow ball valve 118A under the influence of a pressure differential and gravity. The lower part of the cone near center block 110 is spherically shaped to receive Teflon ball 121A for a tight seal. Indices A and B are interchanged for identical inflow ball valve 118B and inflow valve cap 122B.

The outflow shuttle valve best shown in FIG. 4 and FIG. 2 serves both cylinders and operates by a pressure differential. Outflow shuttle cavity 113 containing the outflow shuttle 114 extends perpendicularly between faces A and B of center block 110 with its midpoint perpendicularly connected to the liquid outlet 117 on the small side of center block 110 opposite valve block 150. outflow shuttle 114 is contained within outflow shuttle cavity 113 by outflow valve caps 115A and 115B which are screwed into faces A and B of center block 110, respectively.

At the beginning of an exhaust stroke of bellows 174A the increasing pressure moves the outflow shuttle 114 across outflow shuttle cavity 113 to the outflow valve cap 115B on face B of center block 110. This action opens the pathway for the liquid flow out of bellows 174A through outflow valve cap 115A, outflow shuttle cavity 113 and out of liquid exhaust 117. The simultaneous intake stroke in bellows 174B causes an under pressure which contributes to holding the outflow shuttle tight against outflow valve cap 115B.

Vents 144A and 144B protrude from center block 110 into cylinders 170A and 170B, respectively. They act as pneumatic stroke terminators and provide air for effective cooling of bellows 174A and 174B, especially when pumping liquid at elevated temperatures. A small portion of the working air is constantly flowing from air inlet 160, via center groove 154 of control shuttle 152, the small cross-sections of ducts 141A and 141B in valve block 150, Z-shaped surface channels 140A and 140B formed by the interface between valve block 150 and center block 110, perpendicular ducts 143A and 143B in center block 110 through vents 144A and 144B into the spaces between cylinders 170A and 170B and bellows 174A and 174B, respectively, and to the outside atmosphere via permanently open air vent 145 at the bottom of the center block 110. The length of push rods 173 is determined such that during the exhaust stroke of cylinder 170A O-ring sleeve 172B touches the bottom of cylinder 170B, minimizing the volume of chamber 176B, before O-ring sleeve 172A touches the tip of vent 144A for the prevention of wear and tear of that tip. When O-ring sleeve 172A approaches or touches vent 144A during an exhaust stroke the venting of working gas decreases or even stops and consequently the pressure in that respective duct increases, thus increasing the pressure in surface channel 140A and in duct 142A, which pushes control shuttle 152 into the other extreme position. This action fills chamber 176B with expanding working air and initiates a liquid exhaust stroke in cylinder 170B and a liquid intake stroke in cylinder 170A. The total stroke movement of O-ring sleeves 172A or 172B between empty chambers 176A or 176B and the end of vents 144A or 144B, respectively, is about 1 inch (2.5 cm) in the commercial version of the preferred embodiment of the pump.

Bands 180A and 180B, made out of a high strength material with a low temperature expansion coefficient like metal, special plastic, fiberglass or carbon fibers, surrounds each one of chambers 176A and 176B to serve as encapsulated strength members in order to maintain stable dimensions even when the Teflon becomes softer at elevated temperatures, thus allowing for reliable operation of O-ring sleeves 172A and 172B. In the preferred embodiment the bands are aluminum. These bands are encapsulated within the cylinders 170A and 170B away from the liquid being pumped by laminating cylinder 170A and 170B out of two coaxially slidably engaged hollow cylindrical members including an inside cylindrical member 170A' and 170B' and outside cylindrical members 170A'' and 170B'', respectively.

While the invention has been described in terms of a preferred embodiment, it will be apparent to those persons skilled in the art that numerous modifications can be made thereto without departing from the spirit and scope of the invention. It is intended that these modifications fall within the spirit and scope of the following claims.

We claim:

1. An air operated liquid pump comprising, in combination:

a center body member having liquid inlet and outlet passageways and air inlet and outlet passageways, p1 at least a pair of opposed bellows pumping members mounted at their one ends on opposite faces of said body member and with their other ends movable and free from rigid connection between said bellows and each bellows pumping member surrounded by a cooling chamber and compressible toward said center body member by air in an associated bellows compression chamber, and means for passing air sequentially first to one and then to the other of said bellows compression chambers for successively pumping first from one and then the other of said bellows pumping members.

2. The liquid pump of claim 1 wherein said means for passing air includes means for passing cooling air over the convolutions of said bellows.

3. The liquid pump of claim 1 including liquid inlet ball valve means on each of said center body opposite face sides connecting said liquid inlet passageway to said pumping chambers.

4. In an air operated liquid pump having a center body member having liquid inlet and outlet passageways and air inlet and outlet passageways, at least a pair of opposed bellows pumping members mounted on opposite faces of said center body member and each bellows pumping member compressible toward said center body member by air in an associated bellows compressing chamber, and means for passing air sequentially first to one and then to the other of said bellows compression chambers for successively pumping liquid first from one and then the other of said bellows pumping members, the improvement comprising liquid inlet ball valve means on each of said center body opposite face sides connecting said liquid inlet passageway to said pumping chambers, said ball valve means including a conically caged chamber extending from a valve seat for a ball, said chamber having an upwardly inclined surface and a valve cap partially closing said chamber and capturing said ball in said chamber.

5. The liquid pump of claim 4 wherein said ball valve means includes a pin which can be received in at least one opening in said center body to prevent rotation of said upwardly inclined surface.

6. The liquid pump of claim 4 including an outlet slide valve means for connecting said outlet passageway with whichever of said pumping assemblies is collapsing the bellows thereof.

7. The pump of claim 4 including a cylinder surrounding each of said pumping members and a rigid hollow cylindrical band forming a part of said cylinder for maintaining the shape of said cylinder.

8. The pump of claim 7 wherein said each of said cylinders has a cylindrical side wall having an outer cylindrical portion and an inner cylindrical portion, said rigid band positioned between said inner and outer cylindrical portions.

9. The pump of claim 4 wherein said air passing means includes an elongate shuttle member and a shuttle cylinder block containing said shuttle member with said shuttle cylinder block connected to said center body member and providing communication from an air source to said air passing means for reciprocation of said shuttle member to control movement of said bellows pumping members first in one direction and then in another direction.

10. The pump of claim 9 wherein the length of said shuttle member is held in said shuttle cylinder block slidably vertically whereby said shuttle member is returned by gravity to its vertically downward position when air is shut off to said air passing means.

11. In an air operated liquid pump having a center body member having liquid inlet and outlet passageways and air inlet and outlet passageways, at least a pair of opposed bellows pumping members mounted on opposite faces of said center body member and each bellows pumping member compressible toward said center body member by air in an associated bellows compressing chamber, and means for passing air sequentially first to one and then to the other of said bellows compression chambers for successively pumping liquid first from one and then the other of said bellows pumping members, the improvement comprising said bellows including a plurality of convolutions including end convolutions and at least one centermost convolution and wherein the thickness of the wall of said bellows gradually decreases from the end convolutions and the centermost convolution to locations substantially midway between said centermost convolution and the end convolutions.

12. In an air operated liquid pump having a center body member having liquid inlet and outlet passageways and air inlet and outlet passageways, at least a pair of opposed bellows pumping members mounted on opposite faces of said center body member and each bellows pumping member compressible toward said center body member by air in an associated bellows compressing chamber, and means for passing air sequentially first to one and then to the other of said bellows compression chambers for successively pumping liquid first from one and then the other of said bellows pumping members, the improvement comprising the connection between said center body member and said bellows including a threaded recess having threads on one side of the recess in the side of said center body member with an outwardly tapered edge on the recess opposite the threads thereof and the end of said bellows mounted on said center body member including threads matching the center body recess threads and a tapered portion matching the tapered edge of said recess whereby screw action bringing said center body member and said bellows tightly together exerts radial pressure in the joint therebetween.

13. The pump of claim 12 wherein said recess includes a straight wall depression in the bottom thereof with an outwardly tapered edge opposite said threads and said bellows includes a projection substantially matching said recess depression with a taper on said projection matching the tapered edge of said depression for exerting added radial pressure in the joint.

14. An air operated liquid pump comprising, in combination:

a center body member having liquid inlet and outlet passageways and air inlet and outlet passageways, at least a pair of opposed bellows pumping members mounted on opposite faces of said body member and each bellows pumping member compressible toward said center body member by air in an associated bellows compressing chamber, means for passing air sequentially first to one and then to the other of said bellows compression chambers for successively pumping liquid first from one and then the other of said bellows pumping members, a pair of sleeves each surrounding and connected to one of said bellows pumping members at the end thereof remote form said body member, said center body member having a plurality of bores therethrough aligned with the inner ends of said sleeves and a plurality of push rods extending through said bores between said inner ends of said sleeves whereby the movement of the sleeves connected to one bellows pumping member being compressed toward said center body member moves said push rods and moves the other bellows pumping member away from said center body member.

15. An air operated liquid pump comprising, in combination:

a center body member having liquid inlet and outlet passageways and air inlet and outlet passageways, at least a pair of opposed bellows pumping members mounted on opposite faces of said center body member and each bellows pumping member compressible toward said center body member by air in an associated bellows compression chamber, means for passing air sequentially first to one and then to the other of said bellows compression chambers for successively pumping liquid first from one and then the other of said bellows pumping members, said means for passing air including means for passing cool air over the convolutions of said bellows, a pair of sleeves each surrounding and connected one of said bellows pumping members at the end thereof remote form said center body member, said center body member having a plurality of bores therethrough aligned with the inner ends of said sleeves and a plurality of push rods extending through said bores between said inner ends of said sleeves whereby the movement of the sleeve connected to one bellows pumping member being compressed toward said center body member moves said push rods and moves the other bellows pumping member away from said center body member, said means for passing cooling air including for each bellows pumping member at least one vent tube projecting from the center body and aligned with the inner end of said sleeve connected to said pumping member whereby movement of the sleeve toward said center body member at least partially blocks the flow of air through the vent tube to increase the pressure in said vent tube.

16. The pump of claim 15 in which said sleeve only partially blocks without contacting said vent tube when said bellows has reached its desired compressed state.

17. The pump of claim 16 wherein said air passing means includes an elongate shuttle member and a shuttle cylinder block containing said shuttle member with said shuttle cylinder block connected to said center body member and providing communication from an air source to said air passing means for reciprocation of said shuttle member to control movement of said bellows pumping members first in one direction and then in another direction.

18. The pump of claim 17 wherein the length of said shuttle member is held in said shuttle cylinder block slidably vertically whereby said shuttle member is returned by gravity to its vertically downward position when air is shut off to said air passing means.

19. An air operated liquid pump comprising, in combination:

a center body member having liquid inlet and outlet passageways and air inlet and outlet passageways, at least a pair of opposed bellows pumping assemblies each mounted on an opposite face side of said center body member for producing bellows pumping reciprocation back and forth together, each pumping assembly including a cylinder open at one end which is connected to said center body member and closed at the other end, a sleeve sealably slidable in said cylinder, and a bellows positioned within said cylinder and having an open end which is sealably connected to said center body member and a closed end which is connected to said sleeve forming a compressible pumping chamber within said bellows, said sleeve and said connected closed end of said bellows closing off a compression chamber at the closed end of said cylinder and forming a sliding piston for collapsing said bellows and pumping liquid out of said pumping chamber.

20. The pump of claim 19 including means for passing air sequentially first to one and then to the other of said bellows compression chambers for successively pumping liquid first from one and then the other of said bellows pumping members.

21. The liquid pump of claim 20 wherein said means for passing air includes means for passing cooling air over the convolutions of said bellows.

22. The pump of claim 20 wherein said air passing means includes an elongate shuttle member and a shuttle cylinder block containing said shuttle member with said shuttle cylinder block connected to said center body member and providing communication from an air source to said air passing means for reciprocation of said shuttle member to control movement of said bellows first in one direction and then in another direction.

23. The pump of claim 22 wherein the length of said shuttle member is held in said shuttle cylinder block slidably vertically whereby said shuttle member is returned by gravity to its vertically downward position when air is shut off to said air passing means.

24. The liquid pump of claim 19 including liquid inlet ball valve means on each of said center body opposite face sides connecting said liquid inlet passageway to said pumping chambers.

25. The liquid pump of claim 24 wherein said ball valve means includes a conically caged chamber extending from a valve seat for a ball, said chamber having an upwardly inclined surface and a valve cap partially closing said chamber and capturing said ball in said chamber.

26. The liquid pump of claim 25 wherein said ball valve means includes a pin which can be received in at least one opening in said center body to prevent rotation of said upwardly inclined surface.

27. The liquid pump of claim 19 including an outlet slide valve means for connecting said outlet passageway with whichever of said pumping assemblies is collapsing the bellows thereof.

28. The pump of claim 19 wherein said bellows include a plurality of convolutions including end convolutions and at least one centermost convolution and wherein the thickness of the wall of said bellows gradually decreases from the end convolutions and the centermost convolution to locations substantially midway between said centermost convolution and the end convolutions.

29. The pump of claim 19 wherein each said cylinders includes a rigid hollow cylindrical band forming a part of said cylinder for maintaining the shape of said cylinder.

30. The pump of claim 29 wherein said each of said cylinders has a cylindrical side wall having an outer cylindrical portion and an inner cylindrical portion, said rigid band positioned between said inner and outer cylindrical portions.

31. The pump of claim 19 wherein the connection between said center body member and said bellows includes a threaded recess in the side of said center body member with an outwardly tapered edge on the recess opposite the threads thereof and said open end of said bellows includes threads matching the center body recess threads and a tapered portion matching the tapered edge of said recess whereby screw action bringing said center body member and said bellows tightly together exerts radial pressure in the joint therebetween.

32. The pump of claim 31 wherein said recess includes a straight wall depression in the bottom thereof with an outwardly tapered edge opposite said threads and said bellows includes a projection substantially matching said recess depression with a taper on said projection matching the tapered edge of said depression for exerting added radial pressure in the joint.

33. An air operated liquid pump comprising, in combination:

a center body member having liquid inlet and outlet passageways and air inlet and outlet passageways, p1 at least a pair of opposed bellows pumping assemblies each mounted on an opposite face side of said center body member for producing bellows pumping reciprocation back and forth together, each pumping assembly including a cylinder open at one end which is connected to said center body member and closed at the other end, a sleeve sealably slidable in said cylinder, and a bellows positioned within said cylinder and having an open end which is sealably connected to said center body member and a closed end which is connected to said sleeve forming a compressible pumping chamber within said bellows, said sleeve and said connected closed end of said bellows closing off a compression chamber at the closed end of said cylinder and forming a sliding piston for collapsing said bellows and pumping liquid out of said pumping chamber, said center body member having a plurality of bores therethrough aligned with the inner ends of said sleeves and a plurality of push rods extending through said bores between said inner ends of said sleeves whereby the movement of the sleeve connected to one bellows pumping member being collapsed moves said push rods and moves the other bellows pumping member away from said center body member.

34. An air operated liquid pump comprising, in combination:

a center body member having liquid inlet and outlet passageways and air inlet and outlet passageways, p1 at least a pair of opposed bellows pumping assemblies each mounted on an opposite face side of said center body member for producing bellows pumping reciprocation back and forth together, each pumping assembly including a cylinder open at one end which is connected to said center body member and closed at the other end, a sleeve sealably slidable in said cylinder, and a bellows positioned within said cylinder and having an open end which is sealably connected to said center body member and a closed end which is connected to said sleeve forming a compressible pumping chamber within said bellows, said sleeve and said connected closed end of said bellows closing off a compression chamber at the closed end of said cylinder and forming a sliding piston for collapsing said bellows and pumping liquid out of said pumping chamber means for passing air sequentially first to one and then to the other of said bellows compression chambers or successively pumping liquid first from one and then the other of said bellows pumping members and said center body member having a plurality of bores therethrough aligned with the inner ends of said sleeves and a plurality of push rods extending through said bores between said inner ends of said sleeves whereby the movement of the sleeve connected to one bellows being collapsed moves said push rods and moves the other bellows away from said center body member, said means for passing cooling air including for each bellows at least one vent tube projecting form the center body an aligned with the inner end of said sleeve whereby movement of the sleeve toward said center body member at least partially blocks the flow of air through the vent tube to increase the pressure in said vent tube.

35. The pump of claim 34 in which said sleeve only partially blocks without contacting said vent tube when said bellows has reach its desired compressed state.

36. An air operated fluid pump comprising, in combination:

a center body member having fluid inlet and outlet passageways and air inlet and outlet passageways, at least a pair of opposed bellows pumping assemblies each mounted on an opposite face side of said center body member for producing bellows pumping reciprocation back and forth together, each pumping assembly including a cylinder open at one end which is connected to said center body member and closed at the other end, a sleeve sealably slidable in said cylinder, and a bellows positioned within said cylinder and having an open end which is sealably connected to said center body member and a closed end which is connected to said sleeve forming a compressible pumping chamber within said bellows, said sleeve and said connected closed end of said bellows closing off a compression chamber at the closed end of said cylinder and forming a sliding piston for collapsing said bellows and pumping fluid out of said pumping chamber, a fluid inlet ball valve means on each of said center body opposite face sides connecting said fluid inlet passageway to said pumping chambers, and an outlet slide valve means for connecting said outlet passageway with whichever of said pumping assemblies is collapsing the bellows thereof.

37. The fluid pump of claim 36 including means for passing air sequentially first to one and then to the other of said bellows compression chambers for successively pumping fluid first from said one and then said other of said bellows pumping members.

38. The fluid pump of claim 37 wherein said means for passing air includes means for passing cooling air over the convolutions of said bellows.

39. The pump of claim 37 wherein said air passing means includes an elongate shuttle member and a shuttle cylinder block containing said shuttle member with said shuttle cylinder block connected to said center body member and providing communication from an air source to said air passing means for reciprocation of said shuttle member to control movement of said bellows first in one direction and then in another direction.

40. The pump of claim 39 wherein the length of said shuttle member is held in said shuttle cylinder block slidably vertically whereby said shuttle member is returned by gravity to its vertically downward position when air is shut off to said air passing means.

41. An air operated liquid pump comprising, in combination:

a center body member, at least a pair of opposed bellows pumping assemblies each mounted on an opposite face side of said center body member for producing bellows pumping reciprocation back and forth together, each pumping assembly including a cylinder open at one end which is connected to said center body member and closed at the other end, a sleeve sealably slidable in said cylinder, and a bellows positioned within said cylinder and having an open end which is sealably connected to said center body member and a closed end which is connected to said sleeve forming a compressible pumping chamber within said bellows, said center body member having a plurality of bores therethrough aligned with the inner ends of said sleeves and a plurality of push rods extending through said bores between said inner ends of said sleeves whereby the movement of the sleeve connected to one bellows being collapsed moves said push rods and moves the other bellows away from said center body member.

42. The pump of claim 41 including means for passing air to each of said pumping assemblies for passing cooling air over the convolutions of said bellows including at least one vent tube projecting from the center body and aligned with the inner end of said sleeve whereby movement of the sleeve toward said center body member at least partially blocks the flow of air through the vent tube to increase the pressure in said vent tube.

43. The pump of claim 42 in which said sleeve only partially blocks without contacting said vent tube when said bellows has reach its desired compressed state.

* * * * *